US005346452A

United States Patent [19]

Ku

[11] Patent Number: 5,346,452

[45] Date of Patent: Sep. 13, 1994

[54] ADJUSTABLE AIR RESISTANCE SYSTEM FOR FITNESS EQUIPMENT

[76] Inventor: Tse-Fen Ku, Fl. 5, No. 5, Lane 12, Mo Fan Str., Taichung, Taiwan

[21] Appl. No.: 41,192

[22] Filed: Apr. 1, 1993

[51] Int. Cl.[5] ..... A63B 22/04

[52] U.S. Cl. ..... 482/113; 482/53

[58] Field of Search ..... 482/51, 52, 53, 111, 482/112, 113; 128/25 R; 188/322.13, 322.15, 322.17, 322.14, 322.16, 285, 299

[56] References Cited

U.S. PATENT DOCUMENTS 3,387,843 6/1968 Chandler ..... 482/113
3,529,474 9/1970 Olson et al,. ..... 482/113
4,063,726 12/1977 Wilson ..... 482/112
4,651,986 3/1987 Wang ..... 482/112
5,261,867 11/1993 Chen ..... 482/112

*Primary Examiner*—Stephen R. Crow
*Attorney, Agent, or Firm*—Bacon & Thomas

[57] ABSTRACT

Disclosed is an adjustable air resistance system including two air cylinders fastened to the points of application on a fitness equipment, an air accumulator to receive compressed air from the air cylinders and to give a gradually increased air resistance to the points of application, and a pressure control system to control the pressure of the air accumulator by a programmable control unit through the monitoring of a pressure meter.

5 Claims, 11 Drawing Sheets

ADJUSTABLE AIR RESISTANCE SYSTEM FOR FITNESS EQUIPMENT

BACKGROUND OF THE INVENTION

The present invention relates to an adjustable air resistance system for fitness equipment which is controlled by a programmable control unit to give a gradually increased air resistance to the points of application on a fitness equipment.

A variety of exercising apparatus have been disclosed for the purpose of obtaining a good bodily health and condition, and have appeared on the market. These apparatus commonly use hydraulic cylinders and weights to give a resistance to the points of application, causing the player to consume one's energy. FIG. 1 illustrates a steppers according to the prior art, which comprises a master supporting frame and an auxiliary supporting frame obliquely connected together at the top and respectively supported on the ground by a respective stand, a handlebar mounted on the master supporting frame at the top, a counter mounted on the handlebar in the middle, two pedals suspended from the cross bar on the auxiliary supporting frame by two hydraulic cylinders, a pulley fastened between the master and auxiliary supporting frames to hold a steel rope, which has two opposite ends respectively connected to either pedal. When in use, the hands hold the handles, and the legs step on the pedals alternatively. FIG. 2 illustrates a gym according to the prior art, which is comprised of a leg press, a high pulley, a thigh & knee machine, weights, a shoulder press, a chest press, and a hip flexor. The aforesaid steppers and gym produce certain effects to help the player exercise the muscles. However, they still have drawbacks. The damping moment of the steppers is fixed, and can not be conveniently regulated according to different requirements. Changing the damping moment of the steppers is difficult, because the points of connection between the hydraulic cylinders and the pedals must be changed. In the gym, the weights can be changed so as the load is regulated. However, it is inconvenient to change the weights. While changing, one must stop the exercises. Further, it is dangerous to use the gym during the stage of warm-up. Because the weights produce a high resistance, the muscles may be torn easily during the beginning when entered the exercises.

SUMMARY OF THE INVENTION

The present invention has been accomplished under the aforesaid circumstances. It is therefore an object of the present invention to provide an adjustable air resistance system for fitness equipment which uses air cylinders to produce a gradually increasing air resistance to the points of application on the fitness equipment in which the system is installed, so that the player can warm up smoothly before entering the exercises. It is another object of the present invention to provide an adjustable air resistance system for fitness equipment which uses a programmable control unit to control the pressure of the air accumulator, which receive the pressure of the air cylinders, by means of the monitoring of a pressure meter, so that the air resistance is regulated automatically without stopping the exercises.

DETAILED DESCRIPTION OF THE PREFERRED EMBODIMENT

Figure 1:
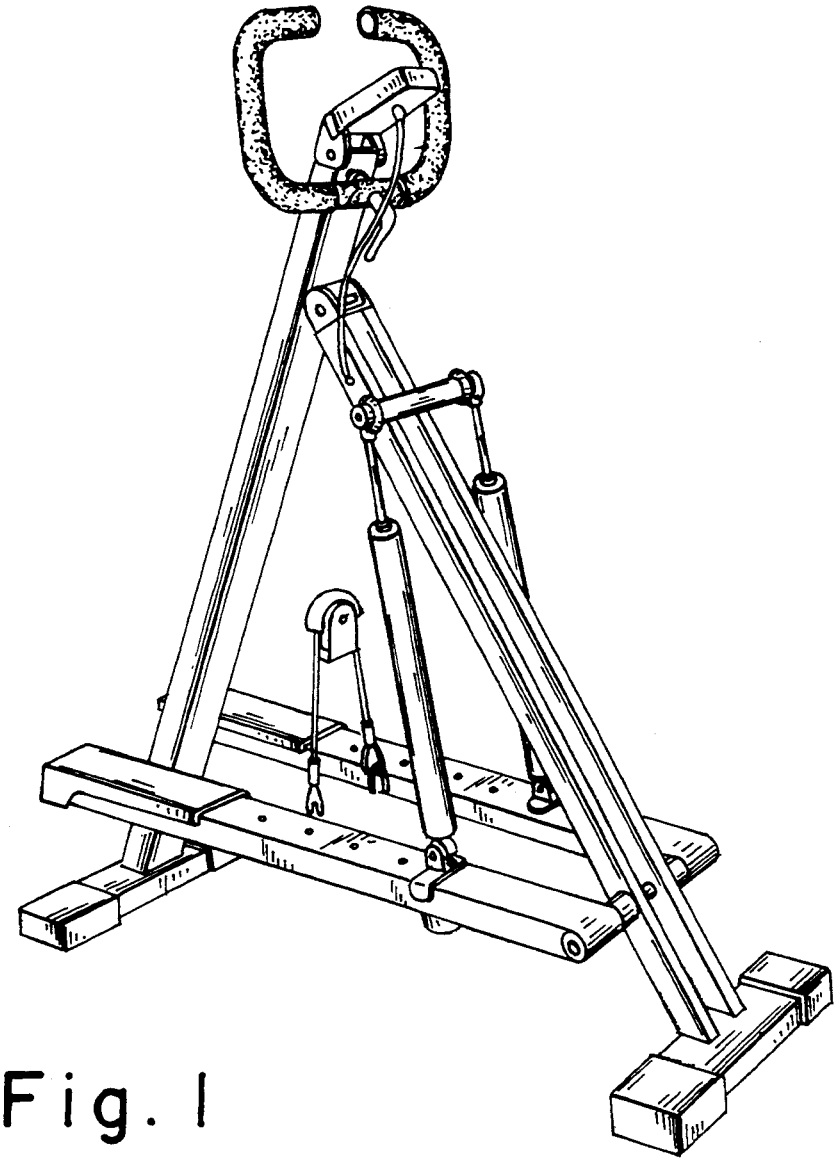
Fig. 1 PRIOR ART
FIG. 1 is a perspective view of a steppers according to the prior art.
Figure 2:
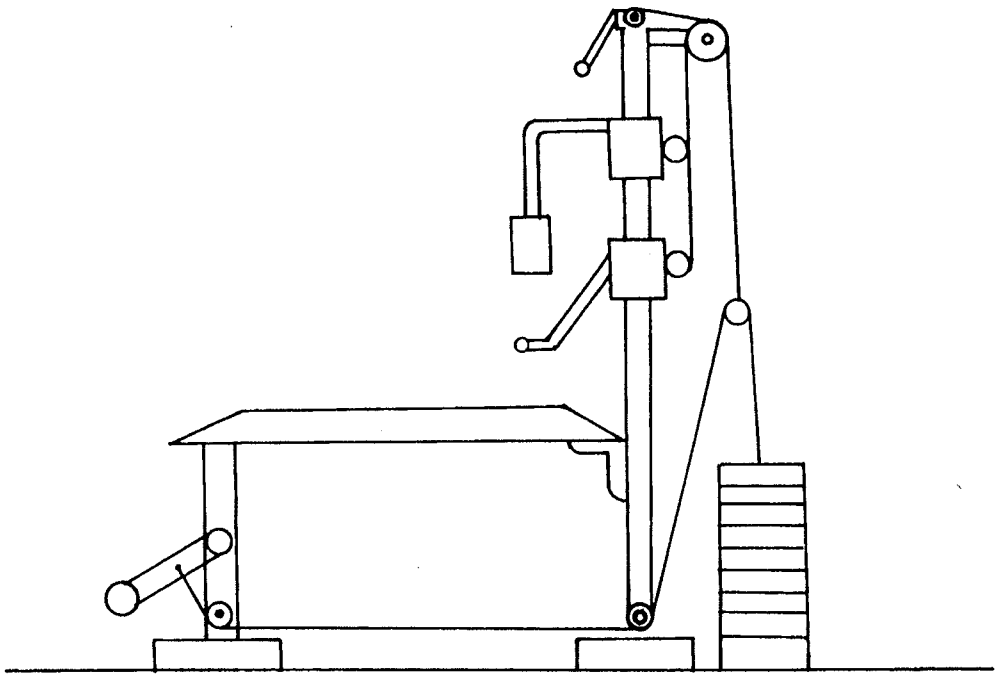
Fig. 2 PRIOR ART
FIG. 2 is a plan view of a gym according to the prior art.
Figure 3:
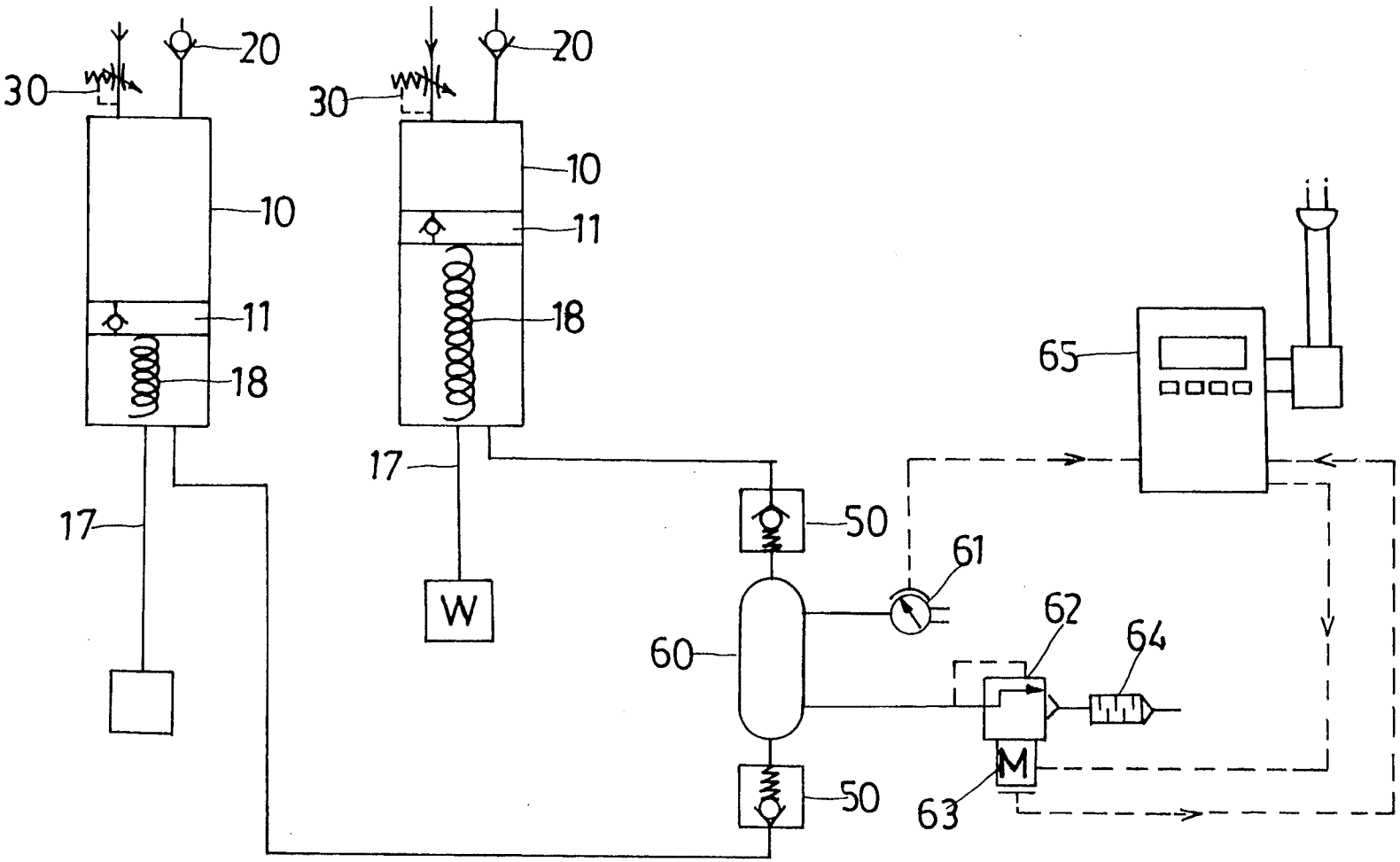
FIG. 3 is a flow chart showing the arrangement of an adjustable air resistance system according to the present invention.

Referring to the flow chart of FIG. 3, there are two air cylinders 10, each having a suction type flow rate regulating valve 30 and a check valve 20 on the outside and a piston valve 11 on the inside. The piston valve 11 of each air cylinder 10 is coupled to a piston rod 17, which has its opposite end extended out of the respective air cylinder 10 and coupled to a respective point of application on a fitness equipment. A compression spring 18 is mounted on the piston rod 17 and retained between the corresponding piston valve 11 and the casing of the respective air cylinder 10. Each air cylinder 10 further has a tubing connected to a common air accumulator 60 through an one-way pressure regulating valve 50. The air accumulator 60 is connected with a pressure meter 61 and an adjustable relief valve 62. The adjustable relief valve 62 is driven to open by a servo motor 63 for the release of the air pressure through a muffler 64 is the air pressure becomes excessive. The servo motor 63 and the pressure meter 61 are respectively connected to a micro processor unit 65 through a decoder. The micro processor unit 65 controls the operation of the servo motor 63 according to the information obtained from the pressure meter 61 so that a constant air pressure maintained in the air accumulator 60.

Figure 4:
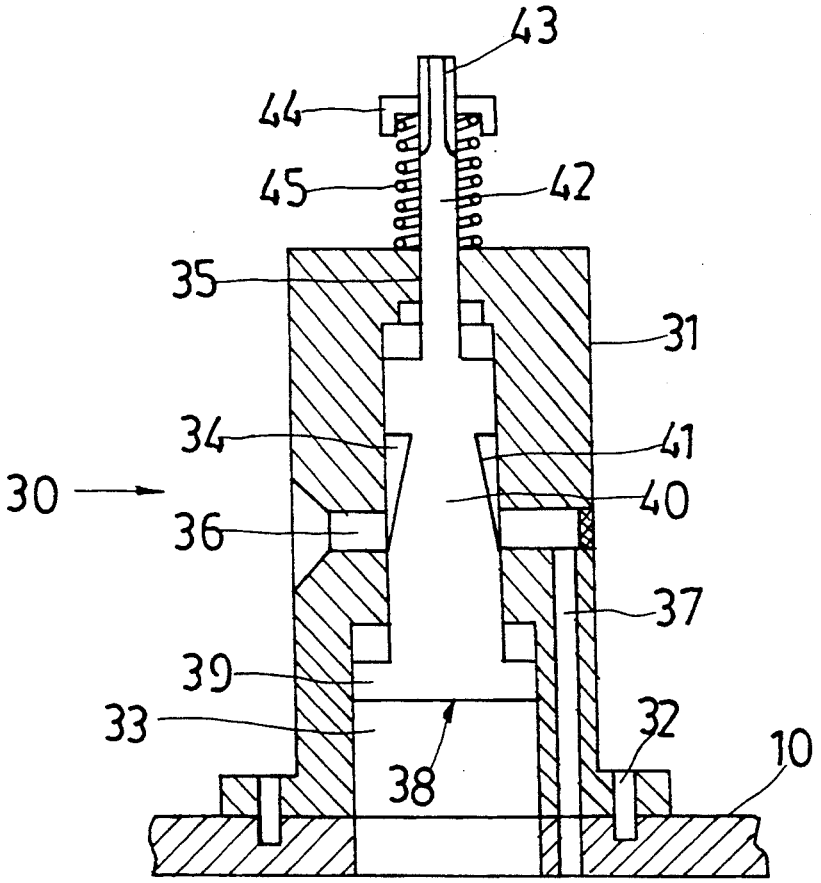
FIG. 4 is a longitudinal sectional view of a suction type flow rate regulating valve according to the present invention.

Referring to FIG. 4, the suction type flow rate regulating valve 30 comprises a casing 31 and a valve body 38. The valve body 38 is made to slide within the casing 31. The casing 31 is made in a cylindrical shape having a plurality of mounting holes 32 around an outward bottom flange thereof respectively fastened to the respective air cylinder 10 by tie screws or suitable fastening elements. A step hole is made through the casing 31 in the longitudinal direction, which forms into a master air chamber 33 at the bottom, a stem hole 35 at the top, and an auxiliary air chamber 34 in the middle. The diameter of the master air chamber 33 is bigger than that of the auxiliary air chamber 34, and the diameter of the auxiliary air chamber 34 is bigger than that of the stem hole 35. The casing 31 further comprises a transverse air passage 36 across the auxiliary air chamber 34, and a vertical air passage 37 extended downwards from one end of the transverse air passage 36 to the bottom. The valve body 38 comprises a collar 39 at the bottom fitted into the air cylinder 10, a barrel 40 in the middle received in the auxiliary air chamber 34, and a stem 42 at the top inserted through the stem hole 35 and extended out of the casing 31. The barrel 40 has a conical surface portion 41 at a suitable elevation. The rear end of the stem 42 is terminated to an outer thread 43 fastened with a regulating knob 44. A spring 45 is mounted on the stem 42 retained between the regulating knob 44 and the casing 31. As the piston valve 11 is moved downwards by the piston rod 17, a vacuum is produced in the air cylinder 10 above the piston valve 11 to suck the valve body 38, causing it to move downwards. As the conical surface portion 41 of the barrel 40 is moved downwards to the transverse air passage 36, the transverse air passage 36 is opened for the passing of the air through the transverse air passage 36 and the vertical air passage 37 into the respective air cylinder 10 to give a buffer action as the respective point of application is being just actuated. The resistance of the buffer action is determined according to the intensity of suction force (vacuum), which can be regulated by turning the regulating knob 44. The suction force (the intensity of the vacuum) is relatively increased by turning the regulating knob 44 in one direction to let the valve body 38 move upwards within the casing 31; the suction force (the intensity of the vacuum) is relatively reduced by turning the regulating knob 44 in the reversed direction to press the valve body 38 downwards.

Figure 5:
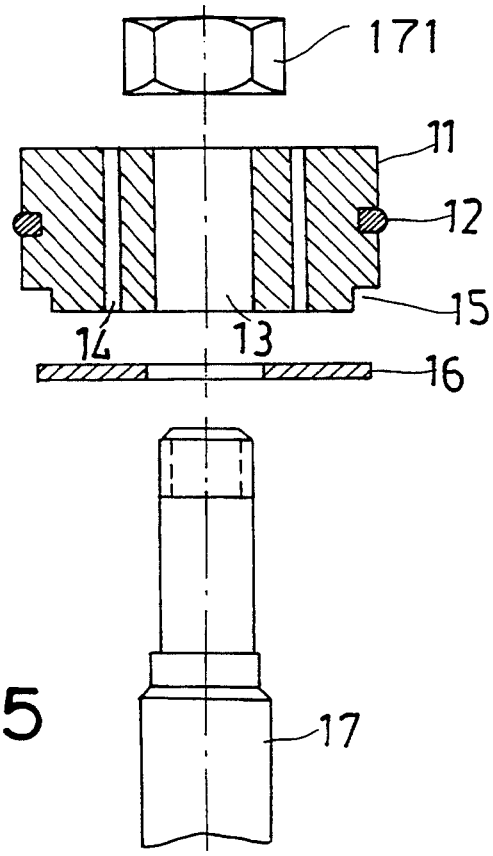
FIG. 5 is a dismantled plan view of a piston valve according to the present invention.
Figure 6:
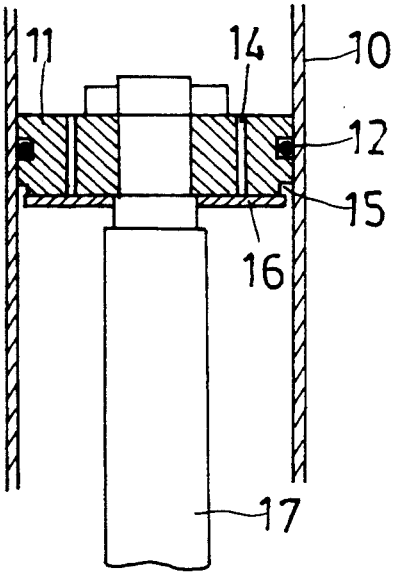
FIG. 6 illustrates the air passages on the piston valve of FIG. 5 blocked up during the down stroke of the piston rod.
Figure 7:
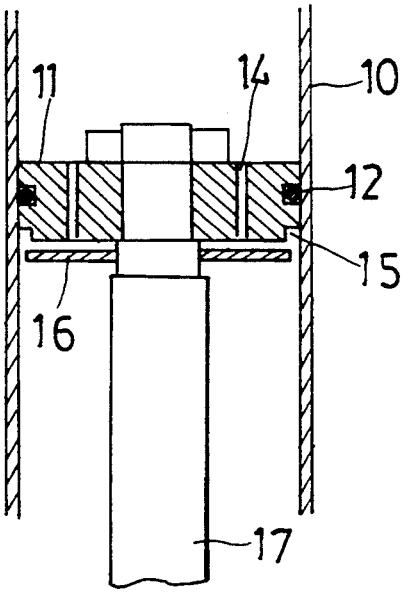
FIG. 7 illustrates the air passages on the piston valve of FIG. 5 opened during the up stroke of the piston rod.

Referring to FIGS. 5, 6 and 7, the piston valve 11 comprises a piston ring 12 mounted on an annular groove (not shown) around the periphery thereof in the middle, a central through hole 13 through its central axis, through which the piston rod 17 is inserted and then locked with a lock nut 171, a plurality of air passages 14 around the central through hole 13, an annular bottom groove 15 around the periphery thereof at the bottom. A gasket 16 is mounted on the piston rod 17 before the insertion of the piston rod 17 into the central through hole 13. When assembled, the gasket 16 and the piston valve 11 are retained to the piston rod 17 by the lock nut 171. As the piston rod 17 is moved downwards, the lower air chamber of the air cylinder 10 is compressed, causing the gasket 16 to closely attach to the piston valve 11 at the bottom, and therefore the air passages 14 are blocked up, as shown in FIG. 6; as the piston rod is moved upwards, the upper air chamber of the air cylinder 10 is compressed causing the compressed air to flow into the air passages 14 in moving the gasket 16 away from the piston valve 11, and therefore the air passages 14 are opened, as shown in FIG. 7. Therefore, the piston valve 11 is a one-way valve.

Figure 8A:
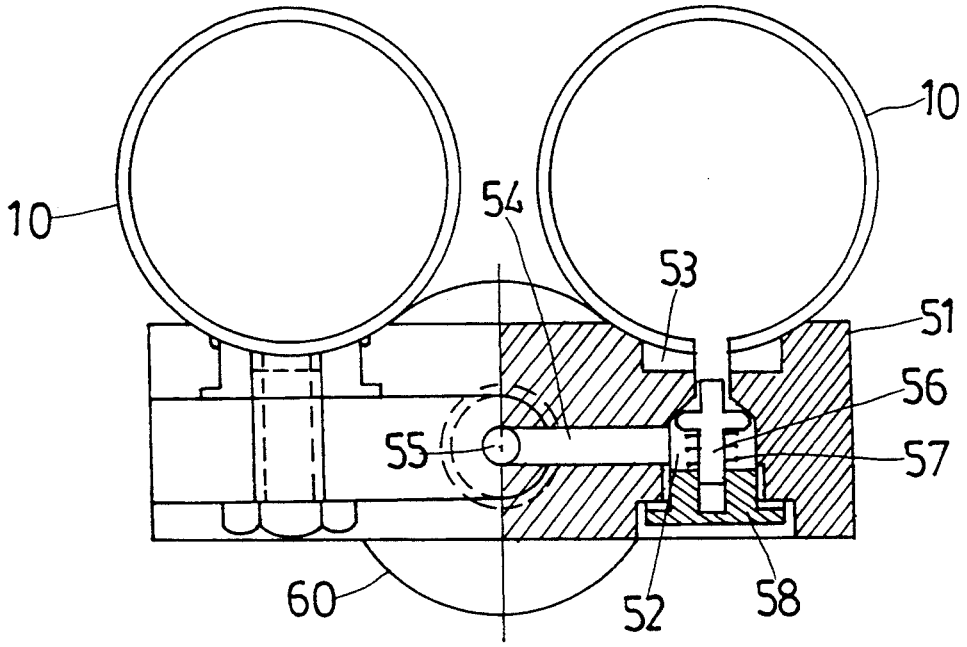
FIG. 8A is a structural view of an one-way pressure regulating valve according to the present invention.
Figure 8B:
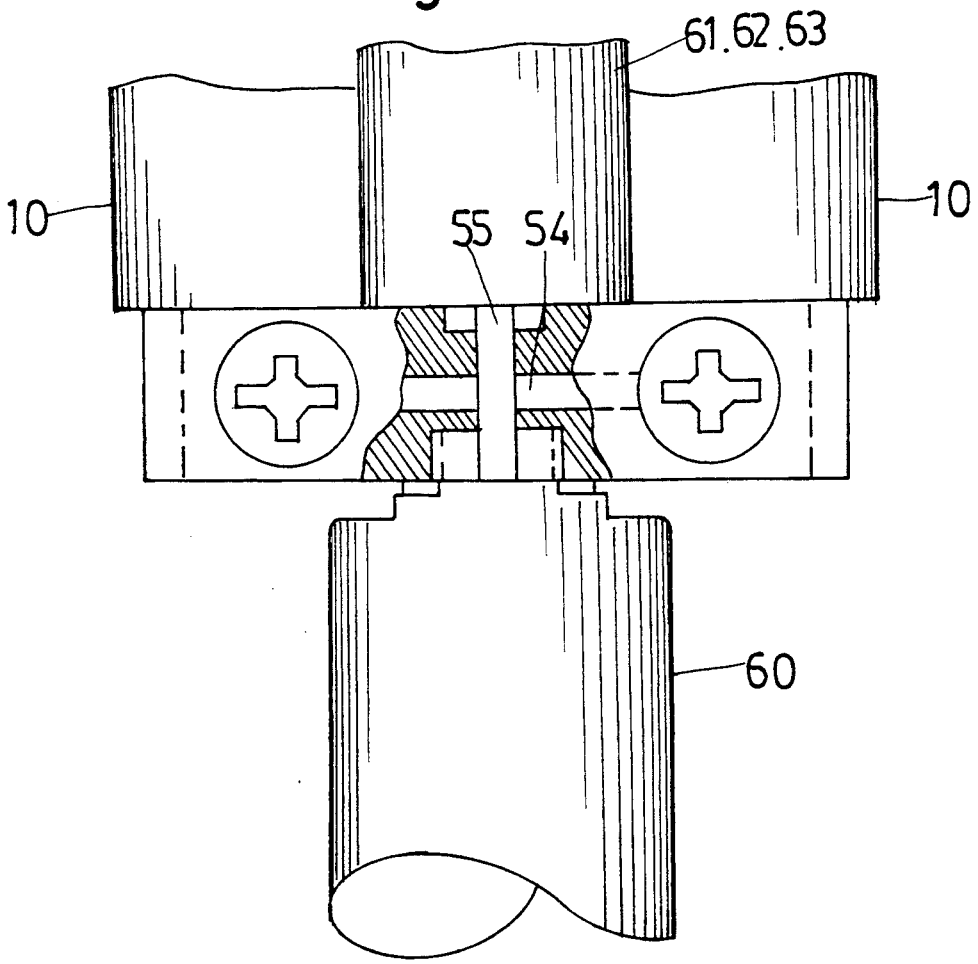
FIG. 8B is a top view of FIG. 8A.

Referring to FIGS. 8A and 8B, the one-way pressure regulating valve 50 comprises a rectangular base 51 having two hopper-shaped air chamber 52. Each air chamber 52 has an air valve 56 locked on the inside by a screw 58. The an air valve 56 has a taper head releasably engaged with the inside wall of the respective air chamber 52, and a stem inserted in a center round hole on the respective screw 58. A spring 57 is mounted on the stem of the air valve 56 and retained between the screw 58 and the head of the air valve 56. Each air chamber 52 has a front port connected to the respective air cylinder 10 and sealed by a leakage-proof gasket 53. An air passage 54 is connected between the two air chambers 52. An air hole 55 is disposed across the air passage 54 in the middle to connect the two air chambers 52 to the air accumulator 60. Because the air hole 55 is connected to air passage 54 in the middle, the air pressure in the two air chambers 52 is constantly maintained in balance. As the piston valve 11 in either air cylinder 10 is moved downwards, the respective air valve 56 is compressed downwards to open the respective air chamber 52 for letting the compressed air to flow into the air accumulator 60; as the pressure is released from the air cylinder 10, the respective air valve 56 is forced by the respective spring 57 to close the respective air chamber 52 from the air cylinder 10, and therefore the compressed air of the air accumulator 60 is stopped from flowing back to the air cylinder 10.

Figure 9:
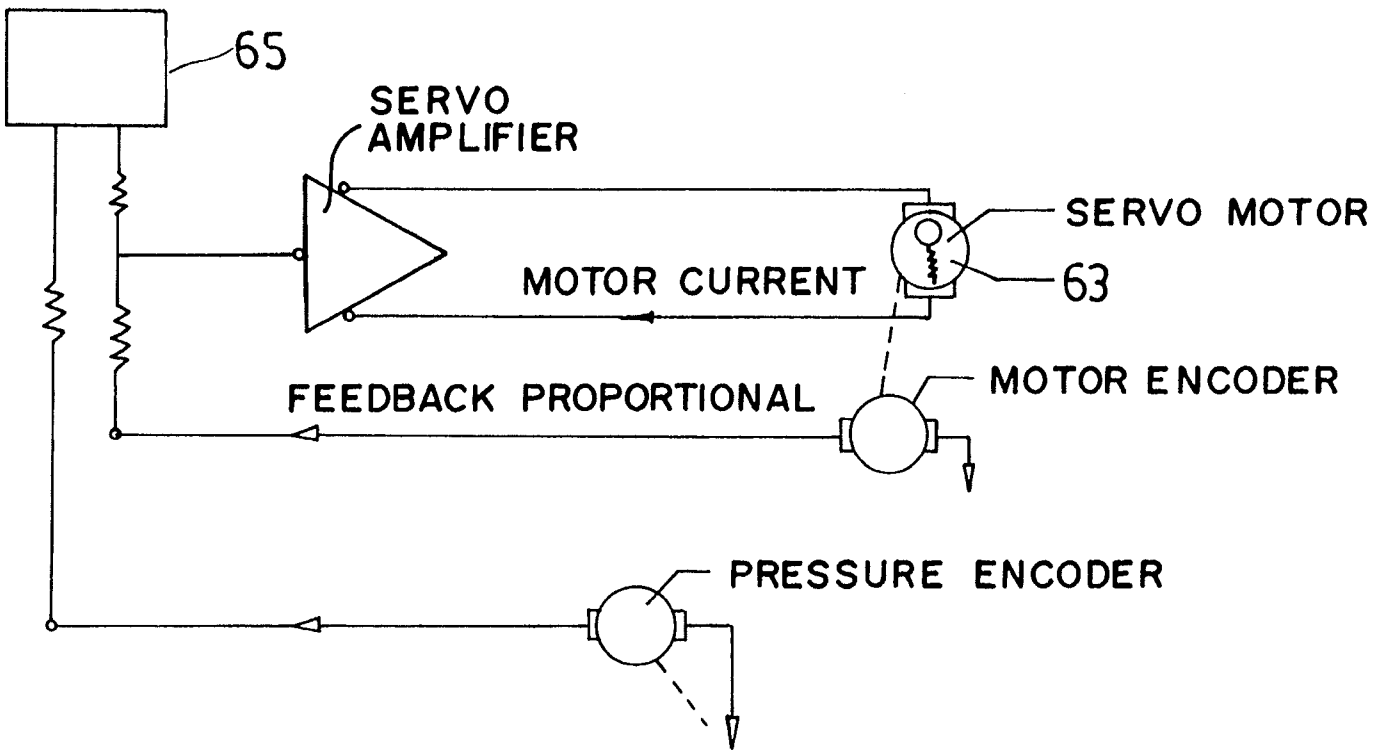
FIG. 9 is a circuit diagram of a pressure control circuit according to the present invention.

Referring to FIG. 9, the pressure setting of the present system is made through the micro processor unit 65. The micro processor unit 65 drives the servo motor 63 through a servo amplifier, to close or open the relief valve 62. This control procedure is performed according to the detection of the pressure meter 61. During the operation, the servo motor 63 and the pressure meter 61 give respective signals to the micro processor unit 65 through a motor encoder and a pressure encoder for automatic correction. Therefore, a predetermined constant pressure can be obtained and maintained.

Figure 10:
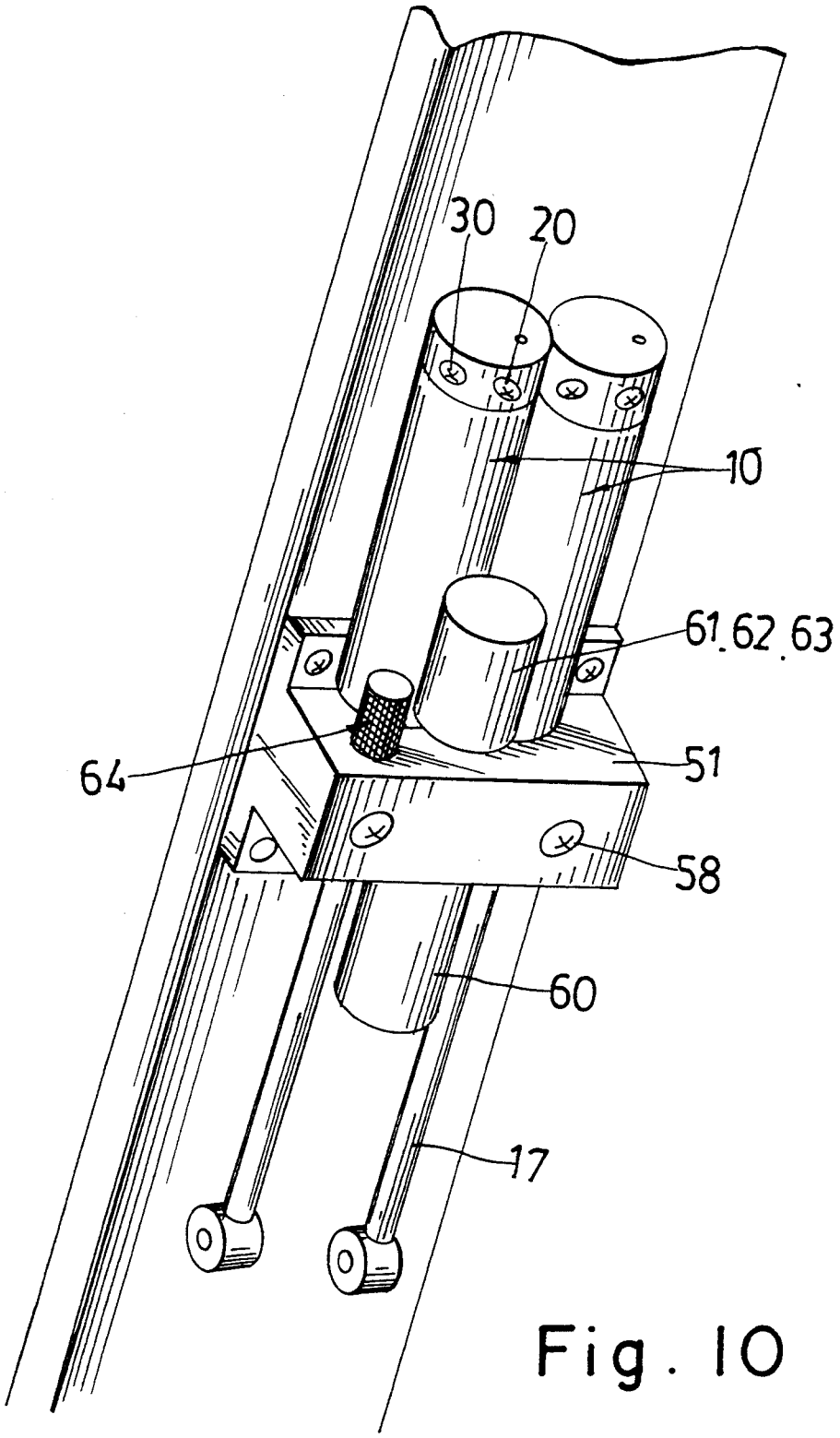
FIG. 10 is a perspective view of an adjustable air resistance system according to the present invention.

Referring to FIG. 10, therein illustrated is the outer appearance of the adjustable air resistance system constructed according to the aforesaid description. Referring to FIG. 3 again, the action of the air cylinders 10 is determined according to the air pressure of the air accumulator 60 controlled by the micro processor unit 65. When an external pressure is applied to either air cylinder 10, the piston rod 17 is forced to carry the piston valve 11 downwards to compress a current of air into the air accumulator 60, which current of air is prohibited from flowing backwards by the one-way pressure regulating valve 50. When the external pressure is released, the compression spring 18 and the residual air pressure push the piston valve 11 upwards for permitting the air in the upper air chamber of the respective air cylinder 10 to partially pass through the air passages 14 into the lower air chamber of the respective air cylinder 10 and partially exhaust out of the respective air cylinder 10 through the check valve 20. This procedure is alternatively performed through the two air cylinders 10, and therefore currents of air are continuously compressed into the air accumulator 60. As the pressure inside the air accumulator 60 becomes excessive, the pressure meter 61 immediately gives a signal to the micro processor unit 65 causing it to drive the servo motor 63, so as to open the relief valve 62 for the relief of the excessive air pressure through the muffler 64. As the pressure inside the air accumulator 60 is reduced below the predetermined level, the relief valve 62 is closed to stop from sending out the air. Therefore, the pressure of the air accumulator 60 is regulated and maintained at the desired level.

According to the aforesaid description, the present invention can achieve the following advantages.

Figure 11:
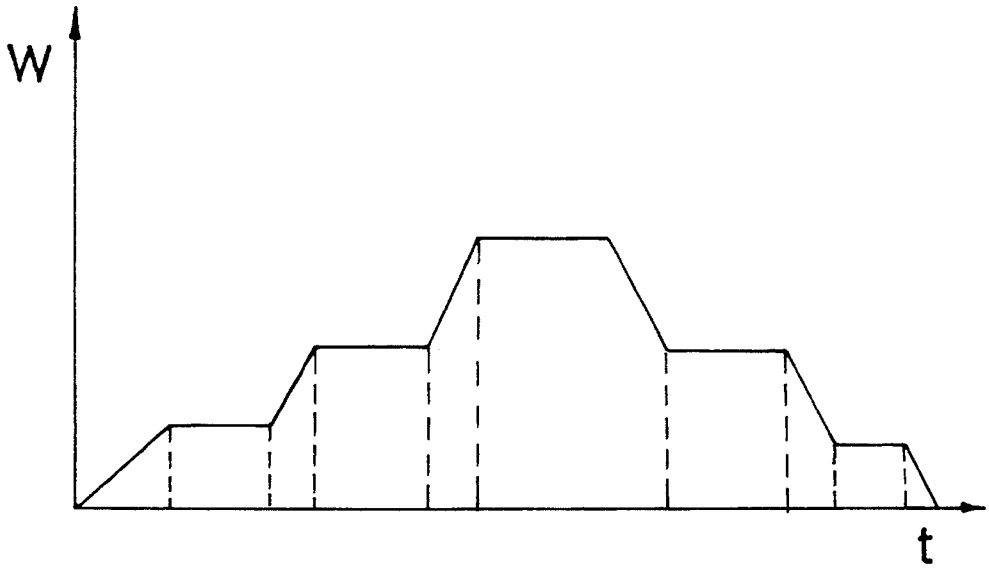
FIG. 11 is a force-time curve according to the present invention.

1. Air is continuously compressed into the air accumulator by the air cylinders to that the applied force to the air cylinders is gradually increased, and the player has sufficient time to warm up the body before starting the exercises.
2. The applied force can be adjusted direction through the micro processor unit 65. By means of the control of a software program, the applied force can be changed with the length of time in a step-like mode as shown in FIG. 11, so as to fit different training requirements or different physical conditions.
3. The suction type flow rate regulating valve 30 prevents from an idle running suddenly when a force is applied to the air cylinder 10 before the air accumulator 60 has a sufficient pressure. The suction force (condition of vacuum) can be regulated through the regulating knob 44 so that the air resistance to the force being applied to the air cylinder 10 is regulated.

Figure 12:
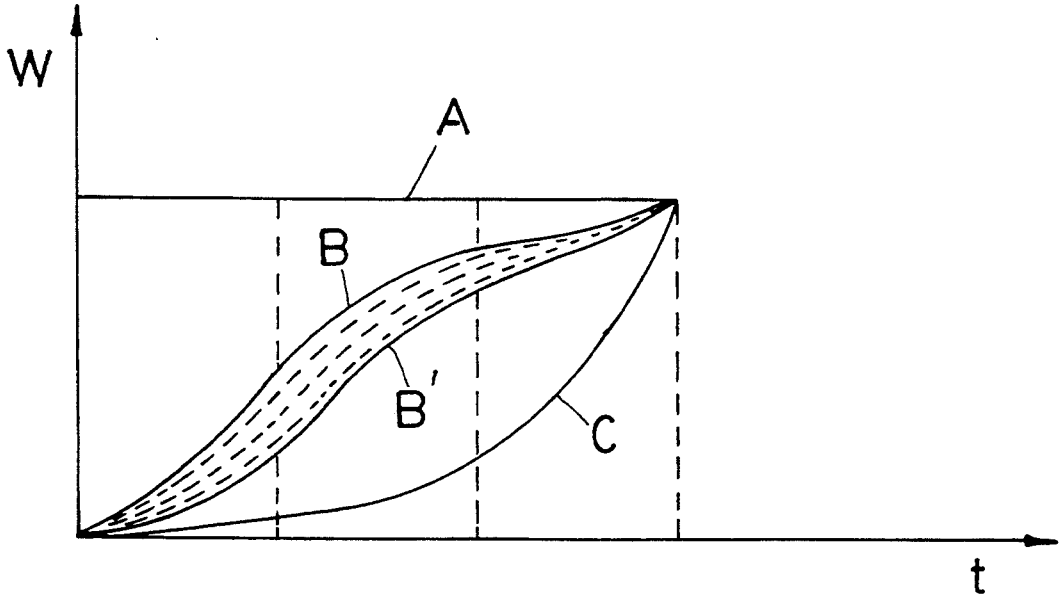
FIG. 12 illustrates different force-time curves at the beginning of the application of the force.

Referring to FIG. 12, therein illustrates are force-time curves showing the relationship between the time and the force at the beginning of the application of the force, in which curve A is obtained according to the prior art; curves B and B' show the upper limit and the lower limit according to the present invention; curve C is obtained according to the present invention when the suction type flow rate regulating valve is not in use. As shown, curve A reflects the same effect without warm-up; curve C may cause a sudden idle running at the beginning of the exercises. The exercising mode shown within curves B and B' gradually increases the force, and provides a buffer action to prevent a sudden idle running at the beginning of the exercises.

Figure 13:
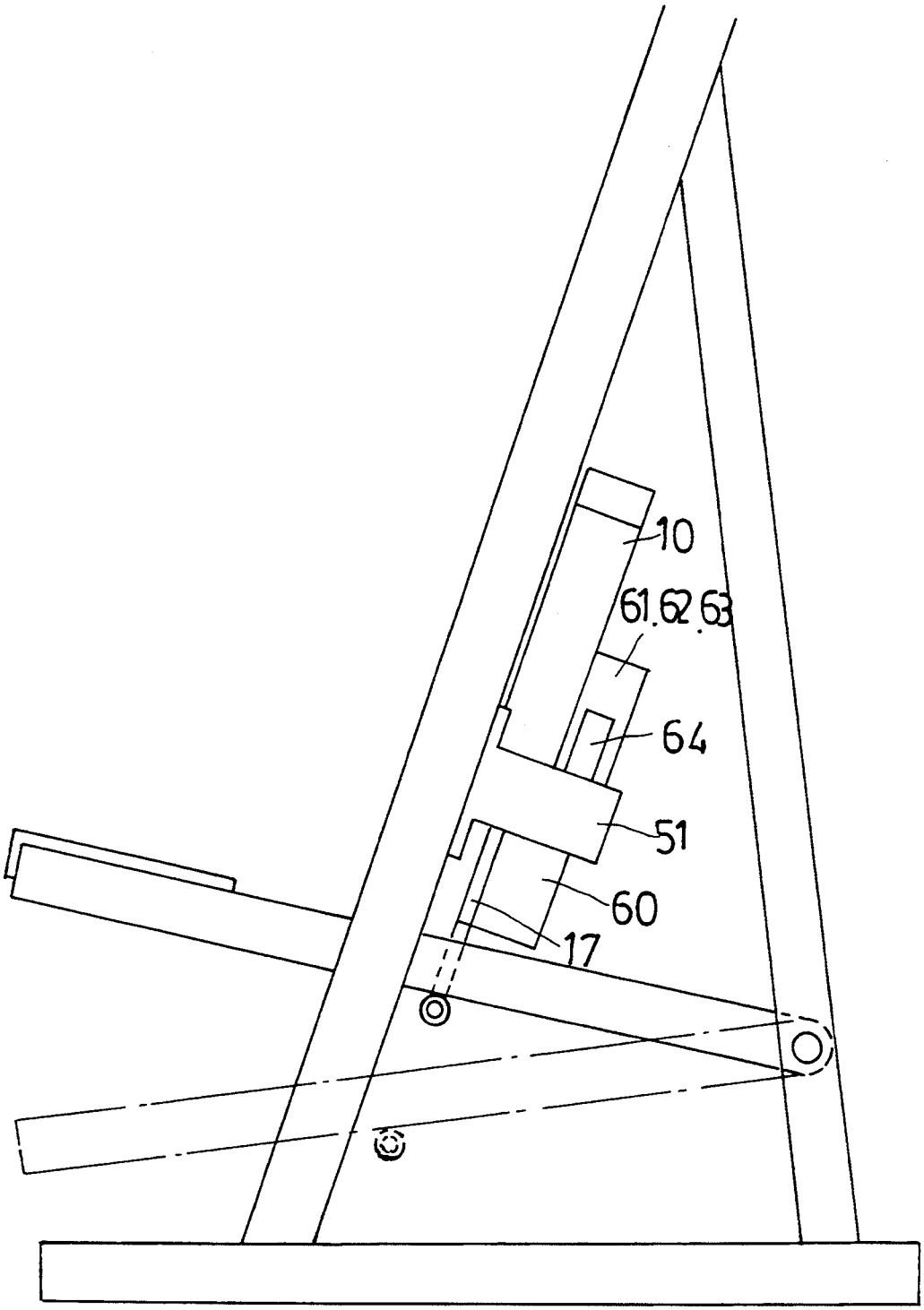
FIG. 13 is an installed view showing the present invention installed in a steppers.
Figure 14:
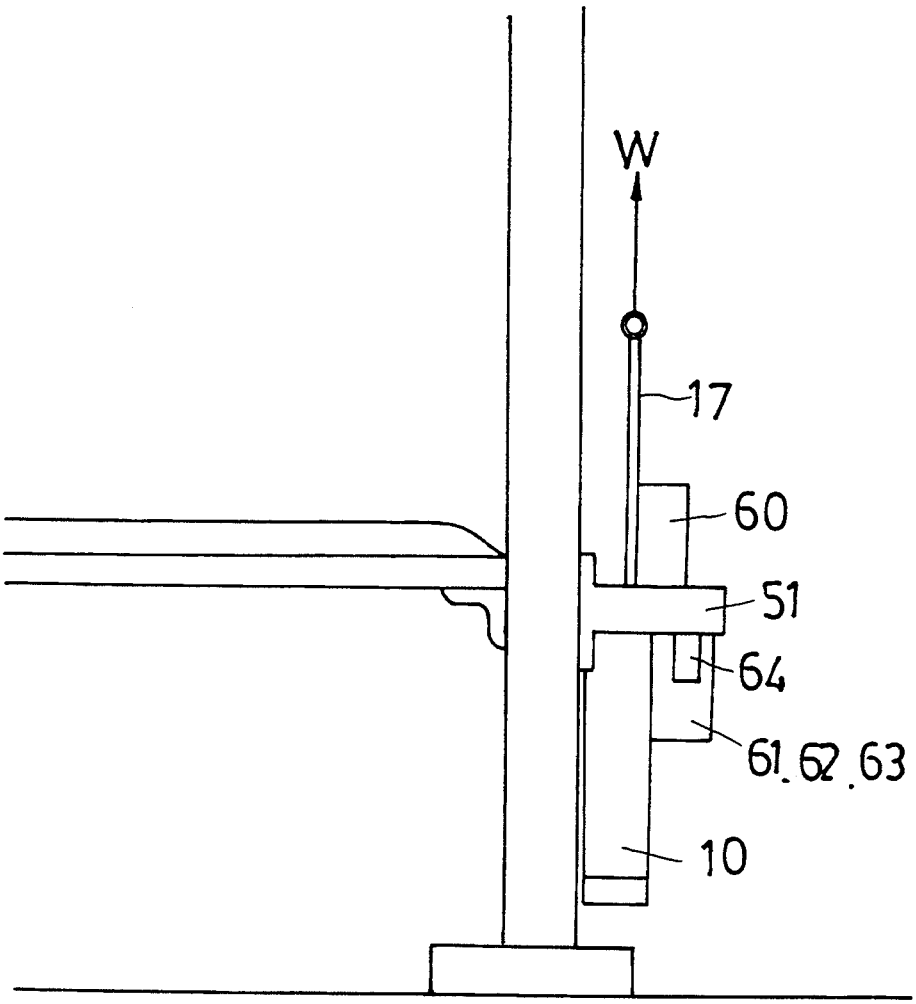
FIG. 14 is another installed view showing the present invention installed in a gym.

Referring to FIGS. 13 and 14, the adjustable air resistance system of the present invention can be installed in any fitness equipment which helps the player warm up the body and regulate the force thorough the control of the micro processor unit.

I claim:

1. An adjustable air resistance system comprising two air cylinders, each having a suction type flow rate regulating valve and a check valve on the outside and a piston valve on the inside, said piston valve being coupled to a piston rod extended out of the respective air cylinder and coupled to a respective point of application on a fitness equipment, said piston rod being mounted with a compression spring retained between said piston valve and the respective air cylinder, each air cylinder being respectively connected to an air accumulator through an one-way pressure regulating valve, and a pressure control system to control the pressure of said air accumulator.

2. The adjustable air resistance system of claim 1 wherein said suction type flow rate regulating valve comprises a casing and a valve body, said casing being made in a cylindrical shape fastened to the respective air cylinder at one end, and having a step hole through its length, a transverse air passage, and a vertical air passage connected between said transverse air passage and the respective air cylinder, said step hole comprising a master air chamber at the bottom, a stem hole at the top, and an auxiliary air chamber in the middle, the diameter of said master air chamber being bigger than that of said auxiliary air chamber, and the diameter of said auxiliary air chamber being bigger than that of said stem hole, said transverse air passage being across said auxiliary air chamber, said valve body comprising a collar at the bottom a barrel in the middle received in said auxiliary air chamber, and a stem at the top inserted through said stem hole and extended out of said casing, said barrel having a conical surface portion and being moved to open or close said transverse air passage, said stem being terminated to an outer thread outside said casing and mounted with a spring and fastened with a regulating knob, the spring being retained between said regulating knob and said casing.

3. The adjustable air resistance system of claim 1 wherein said piston valve comprises a piston ring mounted on an annular groove around the periphery in the middle, a central through hole through its central axis, through which said piston rod is inserted and then locked with a lock nut, a plurality of air holes around the central through hole for passing of air between the chamber above said piston valve and the chamber below said piston valve, an annular bottom groove around the periphery thereof at the bottom, a gasket mounted on said piston rod and moved to block up or open the air holes.

4. The adjustable air resistance system of claim 2 wherein said one-way pressure regulating valve comprises a rectangular base having two hopper-shaped air chambers respectively connected between either air cylinder and said air accumulator, each air chamber having an air valve locked on the inside by a screw, the air valve having a taper head releasably engaged with the inside wall of the respective air chamber and moved to block up or open the passage way between either air cylinder and said air accumulator, and a stem inserted in a center round hole on the respective screw, said stem being mounted with a spring, the spring being retained between the respective screw and the head of the respective air valve.

5. The adjustable air resistance system of claim 1 wherein said pressure control system comprises a pressure meter to detect the pressure of said air accumulator, an adjustable relief valve driven by a servo motor to release the pressure of said air accumulator through a muffler, and a programmable control unit to control said servo motor in opening or closing said adjustable relief valve according to the detection of said pressure meter.

* * * * *